US012161157B2

(12) United States Patent
Lee et al.

(10) Patent No.: US 12,161,157 B2
(45) Date of Patent: Dec. 10, 2024

(54) AEROSOL-GENERATING APPARATUS AND CARTRIDGE USED FOR THE AEROSOL-GENERATING APPARATUS

(71) Applicant: KT&G CORPORATION, Daejeon (KR)

(72) Inventors: Won Kyeong Lee, Guri-si (KR); Heon Jun Jeong, Seoul (KR); Dong Sung Kim, Seoul (KR); Jae Sung Choi, Seongnam-si (KR)

(73) Assignee: KT&G CORPORATION, Daejeon (KR)

( * ) Notice: Subject to any disclaimer, the term of this patent is extended or adjusted under 35 U.S.C. 154(b) by 477 days.

(21) Appl. No.: 17/607,132

(22) PCT Filed: Jul. 13, 2021

(86) PCT No.: PCT/KR2021/008959
§ 371 (c)(1),
(2) Date: Oct. 28, 2021

(87) PCT Pub. No.: WO2022/050560
PCT Pub. Date: Mar. 10, 2022

(65) Prior Publication Data

US 2023/0144164 A1 May 11, 2023

(30) Foreign Application Priority Data

Sep. 7, 2020 (KR) ..... 10-2020-0113747

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/57* (2020.01)

(58) Field of Classification Search
CPC ..... A24F 40/42; A24F 40/40; A24F 40/10; A24F 40/46; A24F 40/57
(Continued)

(56) References Cited

U.S. PATENT DOCUMENTS 10,117,465 B2 * 11/2018 Monsees ..... H05B 3/44
10,709,173 B2 * 7/2020 Monsees ..... A24F 40/42
(Continued)

FOREIGN PATENT DOCUMENTS

CN 101080947 A 11/2007
CN 102014677 A 4/2011
(Continued)

OTHER PUBLICATIONS

Communication dated Mar. 30, 2023, issued in Chinese Application No. 202180004156.5.
(Continued)

*Primary Examiner* — Harshad C Patel
(74) *Attorney, Agent, or Firm* — Sughrue Mion, PLLC

(57) ABSTRACT

A cartridge used for an aerosol-generating apparatus includes a liquid storage configured to store an aerosol-generating material, a heater configured to generate an aerosol by heating the aerosol-generating material, an air flow path through which the aerosol passes to be discharged to the outside of the cartridge, and a heating wire having a mesh shape, configured to generate heat, and arranged in the air flow path such that the aerosol is heated by the heating wire while passing through the air flow path.

14 Claims, 11 Drawing Sheets

(51) Int. Cl.
*A24F 40/46* (2020.01)
*A24F 40/57* (2020.01)

(58) Field of Classification Search
USPC ..... 131/329
See application file for complete search history.

(56) References Cited

U.S. PATENT DOCUMENTS

| | | | | |
|---|---|---|---|---|
| 10,828,435 | B2 | 11/2020 | Yamada et al. | |
| 2008/0000894 | A1 | 1/2008 | Baarman | |
| 2010/0156444 | A1 | 6/2010 | Ponjee et al. | |
| 2013/0081642 | A1 | 4/2013 | Safari | |
| 2016/0374394 | A1 | 12/2016 | Hawes et al. | |
| 2017/0006916 | A1 | 1/2017 | Liu | |
| 2017/0347715 | A1* | 12/2017 | Mironov | A24F 40/42 |
| 2018/0052396 | A1 | 2/2018 | Xie et al. | |
| 2018/0103685 | A1 | 4/2018 | Yener | |
| 2018/0206556 | A1 | 7/2018 | Thorens et al. | |
| 2018/0360116 | A1* | 12/2018 | Schmidt | A24F 40/44 |
| 2019/0008209 | A1* | 1/2019 | Bilat | A61M 11/001 |
| 2019/0142066 | A1 | 5/2019 | Gill et al. | |
| 2019/0191770 | A1 | 6/2019 | Batista et al. | |
| 2019/0343182 | A1* | 11/2019 | Yilmaz | H05B 3/44 |
| 2020/0046025 | A1 | 2/2020 | Otiaba et al. | |
| 2020/0114094 | A1* | 4/2020 | Atkins | A24F 40/40 |
| 2021/0052004 | A1 | 2/2021 | Mironov et al. | |
| 2021/0112868 | A1* | 4/2021 | Han | A24F 40/10 |
| 2021/0364126 | A1 | 11/2021 | Mironov et al. | |
| 2022/0117041 | A1 | 4/2022 | Hopps et al. | |

FOREIGN PATENT DOCUMENTS

| | | | |
|---|---|---|---|
| CN | 103202098 | A | 7/2013 |
| CN | 109414068 | A | 3/2019 |
| EP | 2 613 608 | B1 | 8/2017 |
| JP | 2008-262878 | A | 10/2008 |
| JP | 2016-524458 | A | 8/2016 |
| JP | 2019-516349 | A | 6/2019 |
| JP | 2019-524114 | A | 9/2019 |
| JP | 6671451 | B2 | 3/2020 |
| JP | 2020-114220 | A | 7/2020 |
| KR | 10-2018-0121334 | A | 11/2018 |
| KR | 10-2018-0128853 | A | 12/2018 |
| KR | 10-2019-0095452 | A | 8/2019 |
| SU | 1327951 | A1 | 8/1987 |
| WO | 2015/117701 | A1 | 8/2015 |
| WO | 2017/167647 | A1 | 10/2017 |
| WO | 2018/114441 | A1 | 6/2018 |
| WO | 2020/025654 | A1 | 2/2020 |

OTHER PUBLICATIONS

Office Action issued Jul. 25, 2023 in Japanese Application No. 2021-574748.
International Search Report dated Dec. 10, 2021 in International Application No. PCT/KR2021/008959.
Extended European Search Report issued Jun. 23, 2022 in European Application No. 21794081.6.
Office Action issued Jan. 17, 2023 issued in Japanese Application No. 2021-574748.

* cited by examiner

AEROSOL-GENERATING APPARATUS AND CARTRIDGE USED FOR THE AEROSOL-GENERATING APPARATUS

CROSS REFERENCE TO RELATED APPLICATIONS

This application is a National Stage of International Application No. PCT/KR2021/008959 filed Jul. 13, 2021, claiming priority based on Korean Patent Application No. 10-2020-0113747 filed Sep. 7, 2020.

TECHNICAL FIELD

The disclosure relates to an aerosol-generating apparatus and a cartridge used for the aerosol-generating apparatus.

BACKGROUND ART

Recently, the demand for alternative methods to overcome the disadvantages of general aerosol-generating materials has increased. For example, there is growing demand for a method of generating aerosols by heating an aerosol-generating material stored in a cartridge without combustion of the aerosol-generating material.

DISCLOSURE

Technical Problem

A temperature of an aerosol decreases during a process in which an aerosol is delivered to a user through an air flow path, and therefore, it may be difficult for the user to feel heat from the aerosol like when smoking cigarettes. Therefore, there is demand for technology for imparting a feeling of heat to the aerosol.

The disclosure provides a cartridge that gives thermal sense to an aerosol by heating an aerosol in an air flow path. Technical problems to be solved are not limited to the above-stated technical problems, and other technical problems may be derived from the following embodiments.

Technical Solution

A cartridge used for an aerosol-generating apparatus includes: a liquid storage configured to store an aerosol-generating material; a heater configured to generate an aerosol by heating the aerosol-generating material; an air flow path through which the generated aerosol passes to be discharged to the outside of the cartridge; and a heating wire having a mesh shape, configured to generate heat, and arranged in the air flow path such that the aerosol is heated by the heating wire while passing through the air flow path.

Advantageous Effects

A cartridge may heat an aerosol passing through an air flow path by using a heating wire arranged in an air flow path, thereby giving warmth to the aerosol delivered to a user. Accordingly, a satisfactory smoking experience may be provided to the user. However, advantageous effects of the disclosure are not limited to the above-stated effects, and effects that are not mentioned may be clearly understood by one of ordinary skill in the technical field of the aerosol-generating apparatus from the present specification and the accompanying drawings.

BEST MODE

Figure 1:
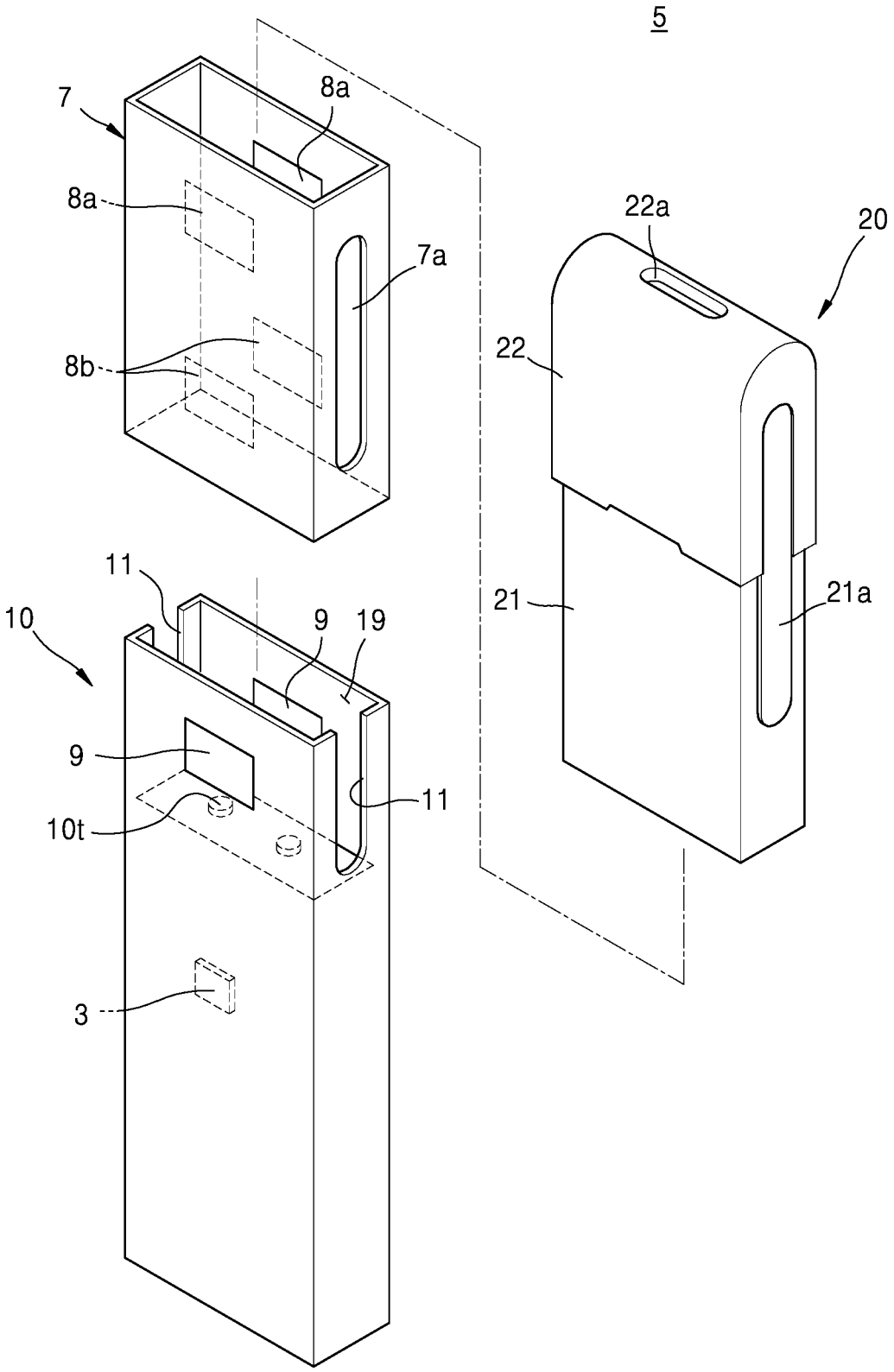
FIG. 1 is an exploded perspective view schematically illustrating a coupling relationship between a replaceable cartridge containing an aerosol-generating material and an aerosol-generating apparatus including the same, according to an embodiment.

A cartridge used for an aerosol generating apparatus includes: a liquid storage configured to store an aerosol-generating material; a heater configured to generate an aerosol by heating the aerosol-generating material; an air flow path through which the generated aerosol passes to be discharged to the outside of the cartridge; and a heating wire having a mesh shape, configured to generate heat, and arranged in the air flow path such that the aerosol is heated by the heating wire while passing through the air flow path.

In addition, the mesh shape comprises a plurality of pores through which the aerosol passes.

Furthermore, a shape of each of the plurality of pores may be a rectangle in which a length of a short side is 0.5 μm or greater and 1.0 μm or less, or a square in which a side is 0.5 μm or greater and 1.0 μm or less.

In addition, the heating wire may be configured to block a portion of the aerosol-generating material entering the air flow path in an unvaporized state from being discharged to the outside of the cartridge.

Furthermore, the heating wire generates the aerosol by heating the portion of the aerosol-generating material that contacts the heating wire.

In addition, the heating wire is formed into a multiple-layer structure in which layers are arranged in a direction in which the air flow path extends.

Furthermore, one layer in the multiple-layer structure is configured to be heated by an electric field generated by another layer in the multiple-layer structure.

In addition, the cartridge further includes a mouthpiece being inserted into an oral cavity of a user and connected to the air flow path, the mouthpiece comprising a discharge hole configured to discharge the generated aerosol out of the cartridge.

Furthermore, a temperature of the heating wire is controlled such that a temperature of the aerosol in the discharge hole reaches a target temperature, based on the temperature of the heater.

In addition, a temperature of the heating wire and a temperature of the heater are controlled to have a negative correlation.

Furthermore, the heating wire heats the generated aerosol such that a temperature of the aerosol in the discharge hole is 45° C. or higher.

In addition, the heating wire heats the generated aerosol such that the temperature of the aerosol in the discharge hole is at least 15° C. higher compared to when the generated aerosol is not heated.

In addition, the heating wire is heated to 60° C. or higher and 80° C. or lower.

Furthermore, the cartridge further includes a contact device configured to provide an electric connection with the aerosol-generating apparatus such that a current is delivered from the aerosol-generating apparatus to the heating wire through the contact device.

An aerosol generating apparatus according to another aspect includes: a cartridge of claim 1; and a processor configured to apply a current to a heater and a heating wire such that the heater and the heating wire are heated.

MODE FOR INVENTION

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

As used herein, terms including an ordinal number such as "first" or "second" may be used to describe various components, but the components should not be limited by the terms. The terms are used only for the purpose of distinguishing one component from other components.

Hereinafter, embodiments of the present disclosure will be described in detail with reference to the drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes a cartridge 20 containing the aerosol generating material and a main body 10 supporting the cartridge 20.

The cartridge 20 may be coupled to the main body 10 when the aerosol generating material is accommodated therein. A portion of the cartridge 20 is inserted into an accommodation space 19 of the main body 10 so that the cartridge 20 may be mounted on the main body 10.

The cartridge 20 may contain an aerosol generating material in any one of, for example, a liquid state, a solid state, a gaseous state, and a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of a glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected considering the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, the cartridge 20 may convert the phase of the aerosol generating material by receiving an electrical signal from the main body 10 and heating the aerosol generating material, or by using an ultrasonic vibration method, or by using an induction heating method. As another example, when the cartridge 20 includes its own power source, the cartridge 20 may generate aerosol by being operated by an electric control signal or a wireless signal transmitted from the main body 10 to the cartridge 20.

The cartridge 20 may include a liquid storage 21 accommodating the aerosol generating material therein, and an atomizer performing a function of converting the aerosol generating material of the liquid storage 21 to an aerosol.

When the liquid storage 21 "accommodates the aerosol generating material" therein, it means that the liquid storage 21 functions as a container simply holding an aerosol generating material and that the liquid storage 21 includes therein an element impregnated with (or containing) an aerosol generating material, such as a sponge, cotton, fabric, or porous ceramic structure.

The atomizer may include, for example, a liquid delivery element (e.g., wick) for absorbing the aerosol generating material and maintaining the same in an optimal state for conversion to aerosol, and a heater heating the liquid delivery element to generate an aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like, and may be implemented by a conductive filament, wound on the liquid delivery element, or arranged adjacent to the liquid delivery element, by using a material such as a nichrome wire.

In addition, the atomizer may be implemented by a heating element in the form of a mesh or plate, which performs both the functions of absorbing the aerosol generating material and maintaining the same in an optimal state for conversion to aerosol without using a separate liquid delivery element and the function of generating aerosol by heating the aerosol generating material.

At least a portion of the liquid storage 21 of the cartridge 20 may include a transparent material so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and the liquid storage 21 may be entirely formed of transparent plastic or glass, and only the protruding window 21*a* corresponding to a portion of the liquid storage 21 may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 through the connection terminal 10*t* or supply a signal related to an operation of the cartridge 20 to the cartridge 20.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The discharge hole 22*a* may be arranged at an end portion of the mouthpiece such that the aerosol may be discharged to the outside of the cartridge 20 through the discharge hole 22*a*. The aerosol discharged through the discharge hole 22*a* may be delivered to an oral cavity of a user, into which the mouthpiece 22 is inserted.

A slider 7 is coupled to the main body 10 to move with respect to the main body 10. The slider 7 covers at least a portion of the mouthpiece 22 of the cartridge 20 coupled to the main body 10 or exposes at least a portion of the mouthpiece 22 to the outside by moving with respect to the main body 10. The slider 7 includes an elongated hole 7*a* exposing at least a portion of the protruding window 21*a* of the cartridge 20 to the outside.

The slider 7 has a container shape with a hollow space therein and both ends open. The structure of the slider 7 is not limited to the container shape as shown in the drawing, and the slider 7 may have a bent plate structure having a clip-shaped cross-section, which is movable with respect to the main body 10 while being coupled to an edge of the main body 10, or a structure having a curved semi-cylindrical shape and a curved arc-shaped cross-section.

The slider 7 includes a magnetic body for maintaining the position of the slider 7 with respect to the main body 10 and the cartridge 20. The magnetic body may include a permanent magnet or a material such as iron, nickel, cobalt, or an alloy thereof.

The magnetic body includes two first magnetic bodies 8*a* facing each other with an inner space of the slider 7 therebetween, and two second magnetic bodies 8*b* facing each other with the inner space of the slider 7 therebetween. The first magnetic bodies 8*a* and the second magnetic bodies 8*b* are arranged to be spaced apart from each other along a longitudinal direction of the main body 10, which is a moving direction of the slider 7, that is, the direction in which the main body 10 extends.

The main body 10 includes a fixed magnetic body 9 arranged on a path along which the first magnetic bodies 8*a* and the second magnetic bodies 8*b* of the slider 7 move while the slider 7 moves with respect to the main body 10. Two fixed magnetic bodies 9 of the main body 10 may be mounted to face each other with the accommodation space 19 therebetween.

Depending on the position of the slider 7, the slider 7 may be stably maintained in a position where an end of the mouthpiece 22 is covered or exposed by a magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move while the slider 7 moves with respect to the main body 10. The position change detecting sensor 3 may include, for example, a Hall IC using the Hall effect that detects a change in a magnetic field and generates a signal.

In the aerosol generating device 5 according to the above-described embodiments, the main body 10, the cartridge 20, and the slider 7 have approximately rectangular cross-sectional shapes in a direction transverse to the longitudinal direction, but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly when extending in the longitudinal direction, and may extend a long way while being curved in a streamlined shape or bent at a preset angle in a specific area to be easily held by the user.

Figure 2:
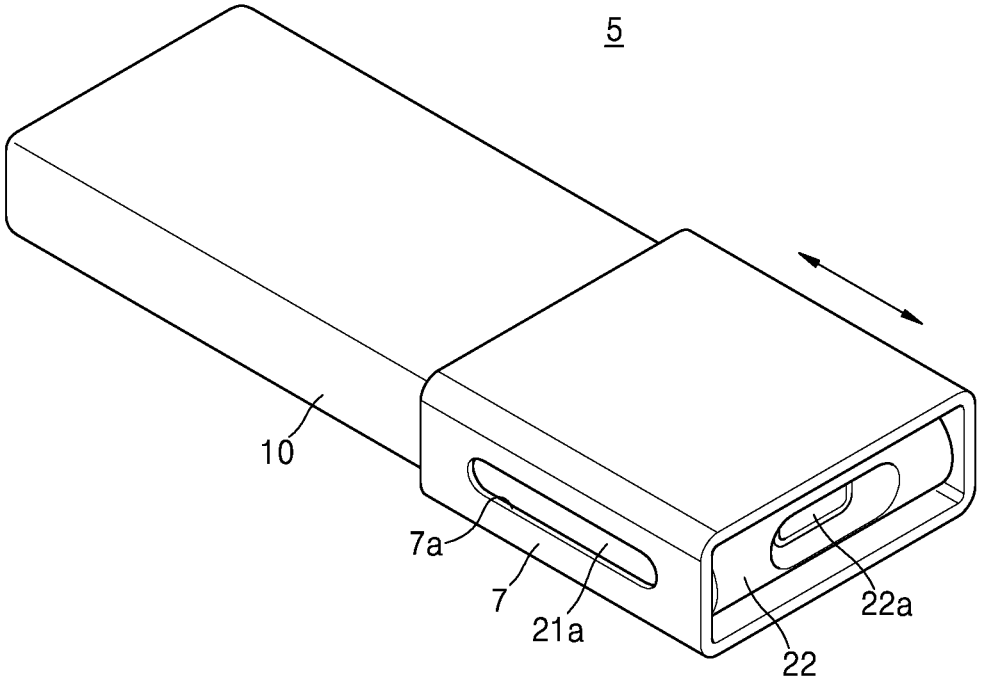
FIG. 2 is a perspective view of an example of an operating state of the aerosol-generating apparatus according to the embodiment illustrated in FIG. 1.

FIG. 2 is a perspective view of an exemplary operating state of the aerosol generating device according to the embodiment illustrated in FIG. 1.

In FIG. 2, the operating state is shown in which the slider 7 is moved to a position where the end of the mouthpiece 22 of the cartridge coupled to the main body 10 is covered. In a state where the slider 7 is moved to the position where the end of the mouthpiece 22 is covered, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

Figure 3:
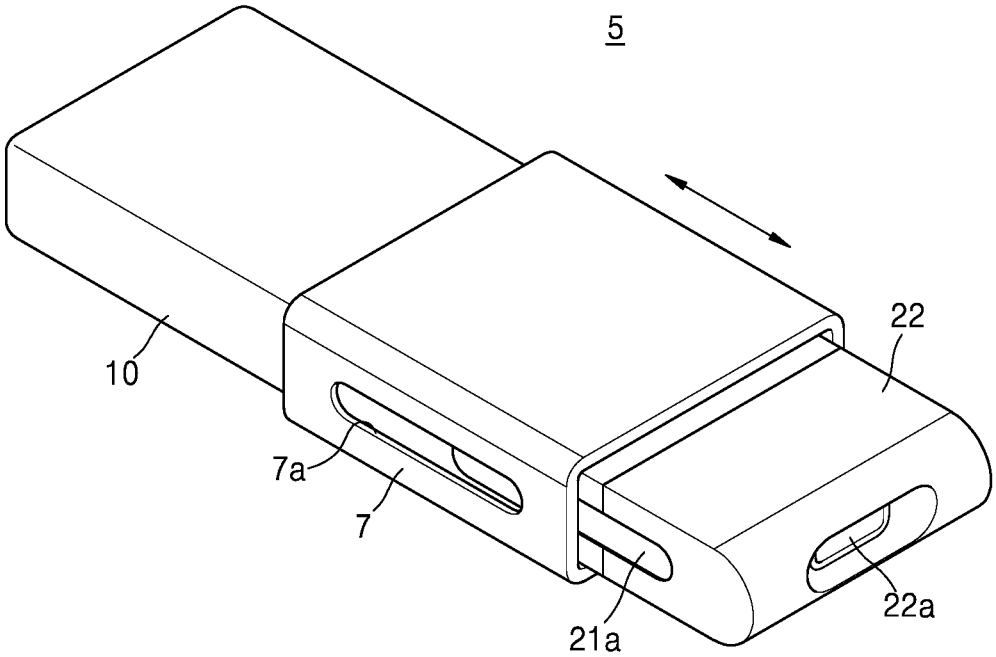
FIG. 3 is a perspective view of another example of an operating state of the aerosol-generating apparatus according to the embodiment illustrated in FIG. 1.

FIG. 3 is a perspective view of another exemplary operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In a state where the slider 7 is moved to the position where the end of the mouthpiece 22 is exposed to the outside, the user may insert the mouthpiece 22 into his or her mouth and absorb aerosol discharged through the discharge hole 22*a* of the mouthpiece 22.

Even when the slider 7 is moved to the position where the end of the mouthpiece 22 is exposed to the outside, the protruding window 21*a* of the cartridge is exposed to the outside through the elongated hole 7*a* of the slider 7, and thus, the user may visually check the remaining amount of aerosol generating material contained in the cartridge.

Figure 4:
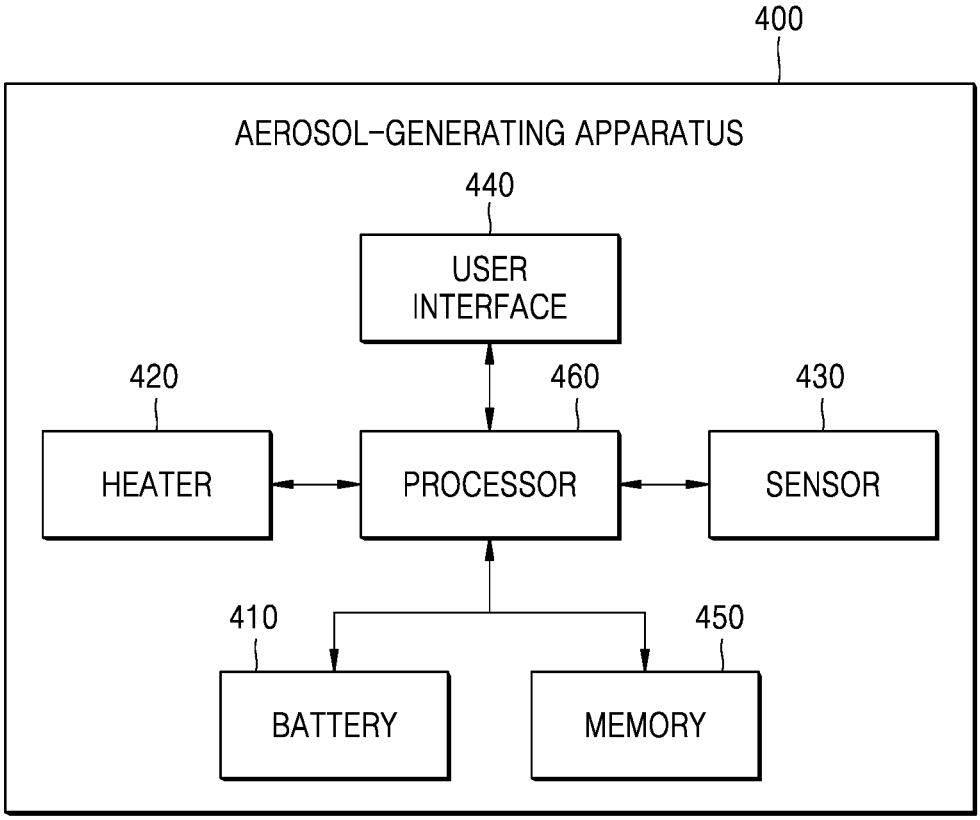
FIG. 4 is a block diagram of an example of a configuration of an aerosol-generating apparatus.

FIG. 4 is a block diagram illustrating components of the aerosol generating device according to an embodiment.

Referring to FIG. 4, the aerosol generating device 400 may include a battery 410, a heater 420, a sensor 430, a user interface 440, a memory 450, and a processor 460. However, the internal structure of the aerosol generating device 400 is not limited to the structures illustrated in FIG. 4. According to the design of the aerosol generating device 400, it will be understood by one of ordinary skill in the art that some of the hardware components shown in FIG. 4 may be omitted or new components may be added.

In an embodiment, the aerosol generating device 400 may consist of only a main body, in which case hardware components included in the aerosol generating device 400 are located in the main body. In another embodiment, the aerosol generating device 400 may consist of a main body and a cartridge, in which case hardware components included in the aerosol generating device 400 are located separately in the main body and the cartridge. Alternatively, at least some of hardware components included in the aerosol generating device 400 may be located respectively in the main body and the cartridge.

Hereinafter, an operation of each of the components will be described without being limited to the location in a particular space in the aerosol generating device 400.

The battery 410 supplies power to be used for the aerosol generating device 400 to operate. In other words, the battery 410 may supply power such that the heater 420 may be heated. In addition, the battery 410 may supply power required for operation of other hardware components included in the aerosol generating device 400, that is, the sensor 430, the user interface 440, the memory 450, and the processor 460. The battery 410 may be a rechargeable battery or a disposable battery. For example, the battery 410 may be a lithium polymer (LiPoly) battery, but is not limited thereto.

The heater 420 receives power from the battery 410 under the control of the processor 460. The heater 420 may receive power from the battery 410 and heat a cigarette inserted into the aerosol generating device 400, or heat the cartridge mounted on the aerosol generating device 400.

The heater 420 may be located in the main body of the aerosol generating device 400. Alternatively, when the aerosol generating device 400 consists of the main body and the cartridge, the heater 420 may be located in the cartridge. When the heater 420 is located in the cartridge, the heater 420 may receive power from the battery 410 located in at least one of the main body and the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto.

In an embodiment, the heater 420 may be a component included in the cartridge. The cartridge may include the heater 420, the liquid delivery element, and the liquid storage. The aerosol generating material accommodated in the liquid storage may be moved to the liquid delivery element, and the heater 420 may heat the aerosol generating material absorbed by the liquid delivery element, thereby generating aerosol. For example, the heater 420 may include a material such as nickel chromium and may be wound around or arranged adjacent to the liquid delivery element.

Meanwhile, the heater 420 may include an induction heater. The heater 420 may include an electrically conductive coil for heating an aerosol generating article in an induction heating method, and the aerosol generating article or the cartridge may include a susceptor which may be heated by the induction heater.

The aerosol generating device 400 may include at least one sensor 430. A result sensed by the at least one sensor 430 is transmitted to the processor 460, and the processor 460 may control the aerosol generating device 400 to perform various functions such as controlling the operation of the heater, restricting smoking, determining whether a cigarette (or a cartridge) is inserted, and displaying a notification.

For example, the at least one sensor 430 may include a puff detecting sensor. The puff detecting sensor may detect a user's puff based on any one of a temperature change, a flow change, a voltage change, and a pressure change.

In addition, the at least one sensor 430 may include a temperature detecting sensor. The temperature detecting sensor may detect the temperature at which the heater 420 (or an aerosol generating material) is heated. The aerosol generating device 400 may include a separate temperature detecting sensor for sensing a temperature of the heater 420, or the heater 420 itself may serve as a temperature detecting sensor instead of including a separate temperature detecting sensor. Alternatively, a separate temperature detecting sensor may be further included in the aerosol generating device 400 while the heater 420 serves as a temperature detecting sensor.

The temperature detecting sensor may detect the temperature of the aerosol that is discharged to the outside of the cartridge. For example, the temperature detecting sensor may measure the temperature of the aerosol in the discharge hole. The temperature detecting sensor may be included in the cartridge, or may be included in the main body of the aerosol-generating apparatus.

In addition, the at least one sensor 430 may include a position change detecting sensor. The position change detecting sensor may detect a change in a position of the slider coupled to the main body to move with respect to the main body.

The user interface 440 may provide the user with information about the state of the aerosol generating device 400. The user interface 440 may include various interfacing devices, such as a display or a light emitter for outputting visual information, a motor for outputting haptic information, a speaker for outputting sound information, input/output (I/O) interfacing devices (e.g., a button or a touch screen) for receiving information input from the user or outputting information to the user, terminals for performing data communication or receiving charging power, and communication interfacing modules for performing wireless communication (e.g., Wi-Fi, Wi-Fi direct, Bluetooth, near-field communication (NFC), etc.) with external devices.

However, the aerosol generating device 400 may be implemented by selecting only some of the above-described examples of various user interface 440.

The memory 450, as a hardware component configured to store various pieces of data processed in the aerosol generating device 400, may store data processed or to be processed by the processor 460. The memory 450 may include various types of memories; random access memory (RAM), such as dynamic random access memory (DRAM) and static random access memory (SRAM), etc.; read-only memory (ROM); electrically erasable programmable read-only memory (EEPROM), etc.

The memory 450 may store an operation time of the aerosol generating device 400, the maximum number of puffs, the current number of puffs, at least one temperature profile, data on a user's smoking pattern, etc.

The processor 460 may generally control operations of the aerosol generating device 400. The processor 460 can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The processor 460 analyzes a result of the sensing by at least one sensor 430, and controls the processes that are to be performed subsequently.

The processor 460 may control power supplied to the heater 420 so that the operation of the heater 420 is started or terminated, based on the result of the sensing by the at least one sensor 430. In addition, based on the result of the sensing by the at least one sensor 430, the processor 460 may control the amount of power supplied to the heater 420 and the time at which the power is supplied, so that the heater 420 is heated to a predetermined temperature or maintained at an appropriate temperature.

In an embodiment, the processor 460 may set a mode of the heater 420 to a pre-heating mode to start the operation of the heater 420 after receiving a user input to the aerosol generating device 400. In addition, the processor 460 may switch the mode of the heater 420 from the pre-heating mode to an operation mode after detecting a user's puff by using the puff detecting sensor. In addition, the processor 460 may stop supplying power to the heater 420 when the number of puffs reaches a preset number after counting the number of puffs by using the puff detecting sensor.

The processor 460 may control the user interface 440 based on the result of the sensing by the at least one sensor 430. For example, when the number of puffs reaches the preset number after counting the number of puffs by using the puff detecting sensor, the processor 460 may notify the user by using at least one of a light emitter, a motor, or a speaker that the aerosol generating device 400 will soon be terminated.

Although not illustrated in FIG. 4, the aerosol generating device 400 may form an aerosol generating system together with an additional cradle. For example, the cradle may be used to charge the battery 410 of the aerosol generating device 400. For example, while the aerosol generating device 400 is accommodated in an accommodation space of the cradle, the aerosol generating device 400 may receive power from a battery of the cradle such that the battery 410 of the aerosol generating device 400 may be charged.

Figure 5:
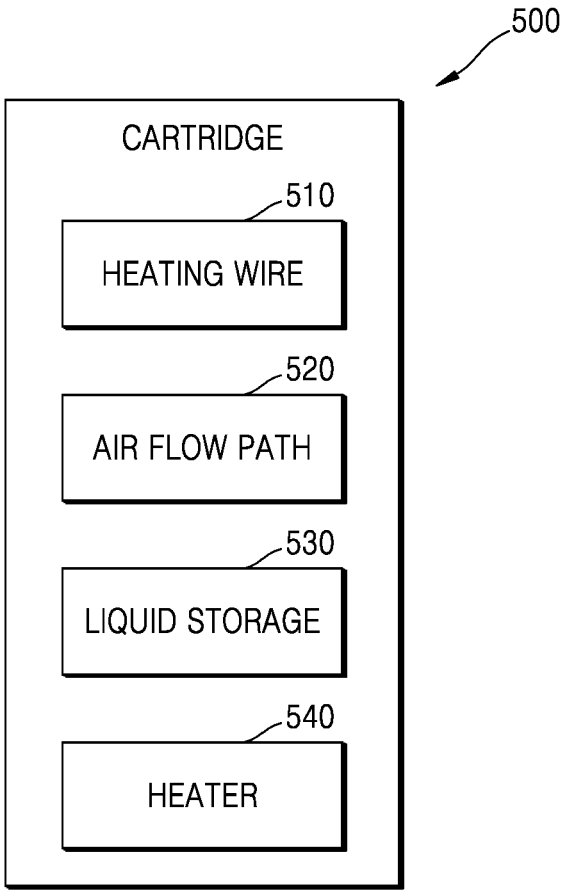
FIG. 5 is a block diagram of an example of a configuration of a cartridge.

FIG. 5 is a block diagram of an example of a configuration of a cartridge.

Referring to FIG. 5, a cartridge 500 may include a heating wire 510, an air flow path 520, a liquid storage 530, and a heater 540. The liquid storage 530 and the heater 540 shown in FIG. 5 may correspond to the liquid storage 21 and the heater described with reference to FIG. 1. The term "aerosol-generating apparatus" described with reference to FIG. 5 may correspond to the main body 10 shown in FIG. 1.

FIG. 5 illustrates components of the cartridge 500, which are related to the present embodiment. Therefore, it will be understood by one of ordinary skill in the art related to the present embodiment that other general-purpose components may be further included in the cartridge 500, in addition to the components illustrated in FIG. 5.

The cartridge 500 may be coupled to the aerosol-generating apparatus in a detachable manner. The cartridge 500 may be electrically connected to the aerosol-generating apparatus through a contact device and the like. The cartridge 500 may operate according to an electric signal, or a wireless signal, and the like received from the aerosol-generating apparatus.

The liquid storage 530 may store the aerosol-generating material. The liquid storage 530 may serve as a container for directly containing the aerosol-generating material, or may have a sponge and the like in which the aerosol-generating material impregnated. The aerosol-generating material may be, for example, any one of a liquid state, a solid state, a gas state, or a gel state. The aerosol generating material may include a liquid composition.

The heater 540 may generate the aerosol by heating the aerosol-generating material. For example, the heater 540 may change a phase of the aerosol-generating material according to an electric signal received from the aerosol-generating apparatus and heating the aerosol-generating material, by using an ultrasonic vibration method, or by using an induction heating method.

In an embodiment, the cartridge 500 may include a mouthpiece (not shown). The mouthpiece according to the present embodiment may correspond to the mouthpiece 22 shown in FIG. 1. At least a portion of the mouthpiece may be inserted into the oral cavity of the user. The mouthpiece may be connected to the air flow path. The mouthpiece may discharge the aerosol out of the cartridge 500 (or the aerosol-generating apparatus) through a discharge hole. The discharge hole according to the present embodiment may correspond to the discharge hole 22*a* shown in FIG. 1.

The air flow path 520 may be a passage through which the aerosol passes to be discharged to the outside of the cartridge 500 (or the aerosol-generating apparatus). In an embodiment, the cartridge 500 may include a liquid delivery element (not shown) configured to receive the aerosol-generating material from the liquid storage 530 and absorb the aerosol-generating material. The air flow path 520 may connect the liquid delivery element and the mouthpiece. The aerosol, which is generated in accordance with heating of the aerosol-generating material absorbed into the liquid delivery element, may pass through the air flow path 520, and then may be discharged to the outside through the mouthpiece.

The heating wire 510 may be arranged in the air flow path 520 so that the aerosol comes into contact with the heating wire 510 while passing through the air flow 520. The heating wire 510 may have a mesh shape. For example, the heating wire 510 may be formed by bending a single metal wire to have intersections such that a plurality of pores are formed. Alternatively, the heating wire 510 may be formed by arranging a plurality of metal wires to intersect with one another such that a plurality of pores are formed. The term "mesh shape" may be interchangeable with "net shape" or "grid shape". The shape of the heating wire 510 will be described in detail with reference to FIG. 7.

The heating wire 510 may heat the aerosol that passes through the air flow path 520. The heating wire 510 may be heated by a current applied from the aerosol-generating apparatus. For example, the heating wire 510 may include kanthal, nichrome, copper (Cu), steel use stainless (SUS), or the like. However, materials included in the heating wire 510 are not limited to the above-stated examples, and the heating wire 510 may include various materials that are heated as a current is applied.

The heater 540 may be arranged to heat the aerosol-generating material, and the heating wire 510 may be arranged to heat the aerosol. When the heater 540 generates the aerosol by heating the aerosol-generating material, the heating wire 510 may heat the aerosol that is generated by the heater 540. Therefore, the heater 540 and the heating wire 510 are arranged in different positions in the cartridge 500 and heat different objects.

Figure 6:
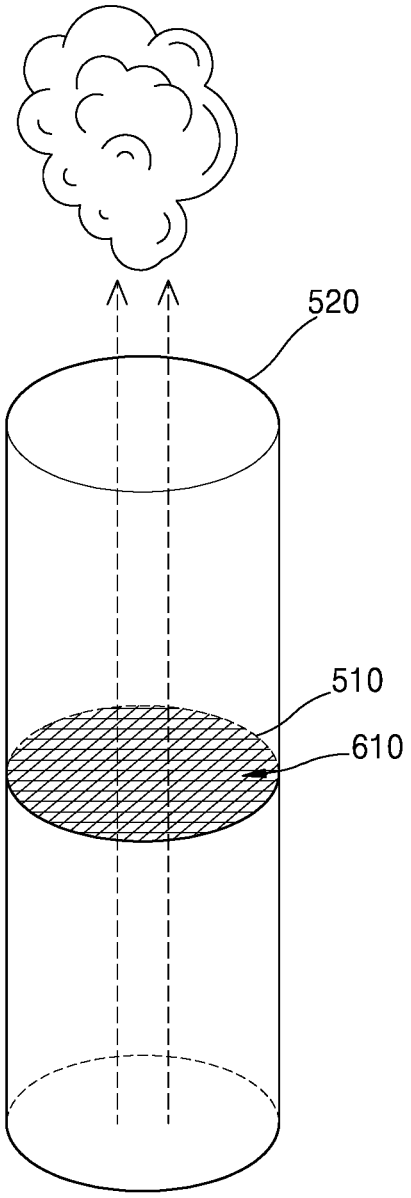
FIG. 6 is a diagram of an example of an arrangement of a heating wire.

FIG. 6 is a diagram of an example of an arrangement of the heating wires.

Referring to FIG. 6, the heating wire 510 may be arranged in the air flow path 520. Accordingly, when the aerosol passes through the air flow path 520, the aerosol may contact the heating wire 510.

A cartridge may include a mesh formed by the heating wire 510, and the aerosol passes through a plurality of pores of the mesh such that the aerosol may be heated by the heating wire 510. For example, the heating wire 510 may be arranged such that a direction in which the air flow path 520 extends is orthogonal to the plane including the plurality of pores 610. However, this is merely an example, and the heating wire 510 may be variously arranged.

The heating wire 510 may include a single metal wire that is bent to have intersections or a plurality of metal wires arranged to cross one another at right angles. The plurality of pores 610 formed by the single metal wire or the plurality of metal wires may have a square shape. However, this is merely an example, and intersecting forms of the metal lines may be variously designed. For example, in the heating wire 510, the metal wires may intersect with each other at a 60 angle, and the shape of the plurality of pores 610 may be a parallelogram or a triangle. Shapes of the heating wire 510 and the plurality of pores 610 may be variously modified from the above-stated examples.

When the aerosol is generated, a temperature of the aerosol is higher than a room temperature, and therefore, the temperature of the aerosol may decrease while the aerosol passes through the air flow path 520 without further heating. Accordingly, the temperature of the aerosol that is discharged to the outside may be lower than the temperature of the aerosol when the aerosol is generated. According to an embodiment, the heating wire 510 may prevent cooling of the aerosol by heating the aerosol in the air flow path 520. The heating wire 510 may heat the aerosol before being discharged to the outside.

A temperature of the heating wire 510 may be controlled such that the temperature of the aerosol that is discharged to the outside of the cartridge reaches a target temperature. For example, the temperature of the heating wire 510 may be controlled such that the temperature of the aerosol in the discharge hole reaches the target temperature. Temperatures of the heating wire 510 and the heater may be controlled by the aerosol-generating apparatus that is combined with the cartridge. The target temperature of the aerosol may be determined to maximize satisfaction of the user when the aerosol is delivered to the user. The target temperature of the aerosol may be variously set according to the composition of the aerosol-generating material, a length of the air flow path, a temperature of the aerosol when the aerosol is generated, the settings configured by the user, or the like.

The temperature of the heating wire 510 may be controlled based on the temperature of the heater. The temperature of the heating wire 510 to achieve the target temperature of the aerosol in the discharge hole may vary depending on the temperature of the aerosol when the aerosol is generated. When the temperature of the heater is relatively high, the temperature of the aerosol when the aerosol is generated may also be relatively high, and the heating wire 510 may achieve the target temperature by heating the aerosol to a relatively small degree. On the contrary, when the temperature of the heater is relatively low, the temperature of the aerosol when the aerosol is generated may also be relatively low, and the heating wire 510 may achieve the target temperature by heating the aerosol to a relatively great degree.

Accordingly, to achieve a constant target temperature of the aerosol in the discharge hole, the temperature of the heating wire 510 may be controlled to be relatively low when the temperature of the heater is relatively high, and the temperature of the heating wire 510 may be controlled to be relatively high when the temperature of the heater is relatively low. For example, the temperature of the heating wire 510 and the temperature of the heater may have a negative correlation.

The heating wire 510 may heat the aerosol such that the temperature of the aerosol in the discharge hole is 45° C. or higher. The heating wire 510 may heat the aerosol to give warmth to the aerosol that is discharged to the outside, but not to the extent that the aerosol is overly heated so satisfaction of the user is reduced. For example, the heating wire 510 may heat the aerosol such that the temperature of the aerosol in the discharge hole is 45° C. or higher and 65° C. or lower.

The heating wire 510 may heat the aerosol such that the temperature of the aerosol in the discharge hole of the cartridge is at least 15° C. higher than when the aerosol is not heated. For example, if the temperature of the aerosol that is discharged to the outside without being heated is 30° C., the heating wire 510 may heat the aerosol such that the temperature of the aerosol is at least 45° C., which is 15° C. higher than 30° C.

The aerosol heated by the heating wire 510 is cooled again passing through a remaining portion of the air flow path 520, and thus, the temperature of the heating wire 510 may be controlled to be higher compared to the target temperature of the aerosol in the discharge hole.

The heating wire 510 may be heated to 60° C. or higher, but may not exceed 80° C. prevent an excessive increase in the temperature of the aerosol. For example, the heating wire 510 may be heated to 60° C. or higher and 80° C. or lower, such that the temperature of the aerosol in the discharge hole is 45° C. or higher and 65° C. or lower.

The target temperature of the aerosol and the temperature of the heating wire 510 are merely examples, and the target temperature of the aerosol and the temperature of the heating wire 510 may be variously set according to the composition of the aerosol-generating material, the length of the air flow path 520, the temperature of the heater, the temperature of the aerosol when the aerosol is generated, the settings configured by the user, or the like.

Figure 7:
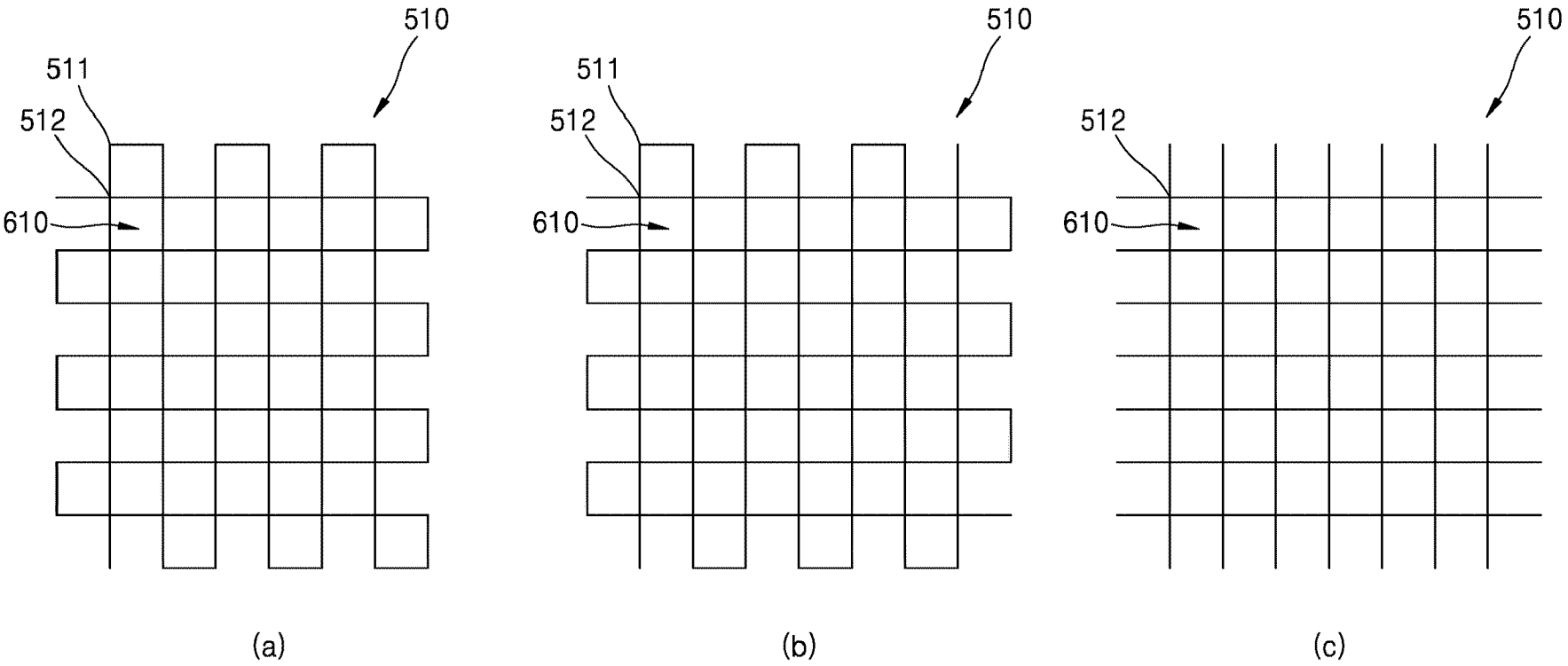
FIG. 7 is a diagram of a plurality of examples of a form of a heating wire.

FIG. 7 is a diagram of a plurality of examples regarding a shape of the heating wire.

Referring to (A) in FIG. 7, the heating wire 510 may made of a single metal wire.

In this case, the single metal wire is repeatedly bent at a bending point 511 such that different portions of the metal wire cross each other at an intersection 512. Accordingly, the plurality of pores 610 may have the intersections 512 as vertices.

In an embodiment according to (a) of FIG. 7, the single metal wire may be repeatedly bent at a 90° angle. In this case, the plurality of pores 610 may have a rectangular shape. However, a degree at which the metal wire is bent and a shape of the pores 610 may vary according to embodiments. For example, the metal wire may not be bent at a uniform angle and the heating wire 510 may have different bending angles of the metal wire.

Referring to (b) of FIG. 7, the heating wire 510 may include a plurality of metal wires.

The heating wire 510 may be formed such that the plurality of metal wires are repeatedly bent at a specific angle and intersect with each other. The plurality of metal wires may be arranged to cross each other at the intersection 512. The heating wire 510 may include the plurality of pores 610, which have the intersections 512 as vertices.

In an embodiment, according to (b) of FIG. 7, two wires may each be repeatedly bent at a 900 angle. The two metal wires may intersect with each other at a 90° angle. In this case, the plurality of pores 610 may have a rectangular shape. However, the number of metal wires, a degree at which the metal wires are bent, and a shape of the pores 610 shown in (b) of FIG. 7 are merely examples and may be implemented with various modification. For example, the heating wire 510 may be formed by more than two metal wires that intersect with each other.

Referring to (c) of FIG. 7, the heating wire 510 may include a plurality of metal wires that are not bent.

Some of the plurality of metal wires may be arranged horizontally, and others may be arranged vertically such that the horizontal metal wires and the vertical metal wires intersect with each other. However, the number of metal wires and an angle between the metal wires shown in (c) of FIG. 7 are merely examples, and may be implemented with various modification.

In addition, although not shown in FIG. 7, the heating wire 510 may include both a bent metal wire and an unbent metal wire. The heating wire 510 may have any shapes, as long as the plurality of pores 610 are formed.

Figure 8:
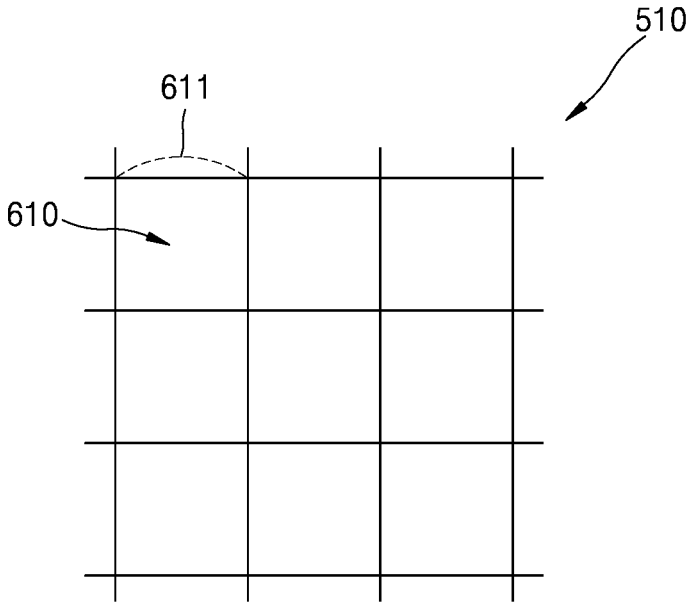
FIG. 8 is a diagram of an example of a plurality of pores.

FIG. 8 is a diagram of an example of the plurality of pores.

Referring to FIG. 8, a pore 610 may be formed by the heating wire 510 having the mesh shape.

The aerosol may pass through the pore 610 and may be heated by the heating wire 510. The pore 610 may be formed large enough for the aerosol to pass. For example, an area of the pore 610 may be greater than a cross-sectional area of an aerosol particle. However, as the size of the pore 610 decreases, an amount of the aerosol that passes for a unit time period may decrease. Thus, the size of the pores 610 may be greater than a threshold size for passing the aerosol. Accordingly, decrease in the amount of the aerosol passing during the unit time period may be prevented.

At the same time, the size of the pore 610 may be formed small enough to heat the aerosol passing during a short time period. As the size of the pore 610 increases, aerosol particles passing through the pore 610 receive heat from a longer distance, and therefore, may be heated less. Accordingly, the pore 610 may be formed large enough for the aerosol to easily pass, and may be formed small enough for the aerosol to be sufficiently heated.

The pore 610 may have the shape of a rectangle, in which a length of a shorter side 611 is 0.5 μm or greater and 1.0 μm or less. Alternatively, the pore 610 may have the shape of a square, in which a length of a side 611 is 0.5 μm or greater and 1.0 μm or less. If a diameter of each aerosol particle is 0.2 μm or greater and 0.4 μm or less, a length of each side 611 of the rectangular pore 610 may be 0.5 μm or greater, such that the pore 610 may allow all particles to pass. As the length of the side 611 of the pore 610 is greater than the diameter of the aerosol particles by at least 0.1 μm, the aerosol may easily pass the pore 610. In addition, if a length of each side 611 of the pore 610 is 1.0 μm or less, the aerosol may be sufficiently heated during a short time period. However, the foregoing numerical values regarding the size of the pore 610 are merely examples, and may be variously modified according to a size of the aerosol particle, a temperature to which the heating wire is heated, or the like.

Figure 9:
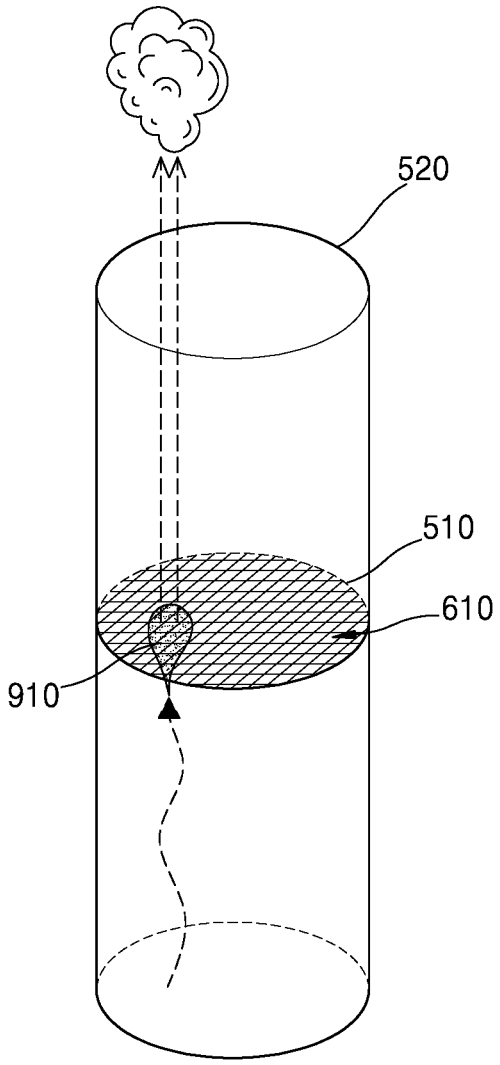
FIG. 9 is a diagram of an example in which a portion of an aerosol-generating material contacts a heating wire.

FIG. 9 is a diagram of an example in which a portion of the aerosol-generating material contacts the heating wire.

Referring to FIG. 9, a portion 910 of the aerosol-generating material may contact the heating wire 510.

As the aerosol-generating material is heated, flicking of the aerosol-generating material may occur. Flicking of the aerosol-generating material refers to a phenomenon that a portion 910 of the aerosol-generating material 910 that is not vaporized is flicked into the air flow path 520. If there is no heating wire, as flicking of the aerosol-generating material occurs, the portion 910 of the aerosol-generating material may be discharged to the outside of the cartridge in a non-vaporized state.

According to an embodiment, when the portion 910 of the aerosol-generating material enters the air flow path 520, the heating wire 510 may contact the portion 910 of the aerosol-generating material, thereby preventing the portion 910 of the aerosol-generating material from being discharged to the outside of the cartridge. The portion 910 of the aerosol-generating material in the non-vaporized state is the aerosol particles combined with one another, and thus, it is much larger than an aerosol particle. Since a size of the pore 610 is slightly larger than that of an aerosol particle, the portion 910 of the aerosol-generating material may contact the heating wire 510 without passing through the pore 610. Accordingly, the cartridge may prevent the aerosol-generating material, which is not vaporized by using the heating wire 510, from being discharged to the outside and provided to the user.

The heating wire 510 may generate the aerosol by heating the portion 910 of the aerosol-generating material that is in contact with the heating wire 510. The heating wire 510 may prevent the aerosol-generating material in the non-vaporized state from being discharged to the outside and, at the same time, may generate the aerosol by vaporizing the portion 910 of the aerosol-generating material that is contact with the heating wire 510.

The portion 910 of the aerosol-generating material that has been flicked is not vaporized but is already heated, so its temperature may be higher than that of the aerosol-generating material stored in the liquid storage (or the liquid delivery element). Thus, it may need less heat for vaporization. In addition, the portion 910 of the aerosol-generating material that is in contact with the heating wire 510 has a smaller mass and a smaller heat capacity than the aerosol-generating material stored in the liquid storage (or the liquid delivery element), and thus, a temperature of the portion 910 of the aerosol-generating material may rapidly increase even when a small amount of heat is applied. Accordingly, even when the temperature of the heating wire 510 is controlled to have a lower temperature than the heater, the heating wire 510 may generate the aerosol from the portion 910 of the aerosol-generating material.

Figure 10:
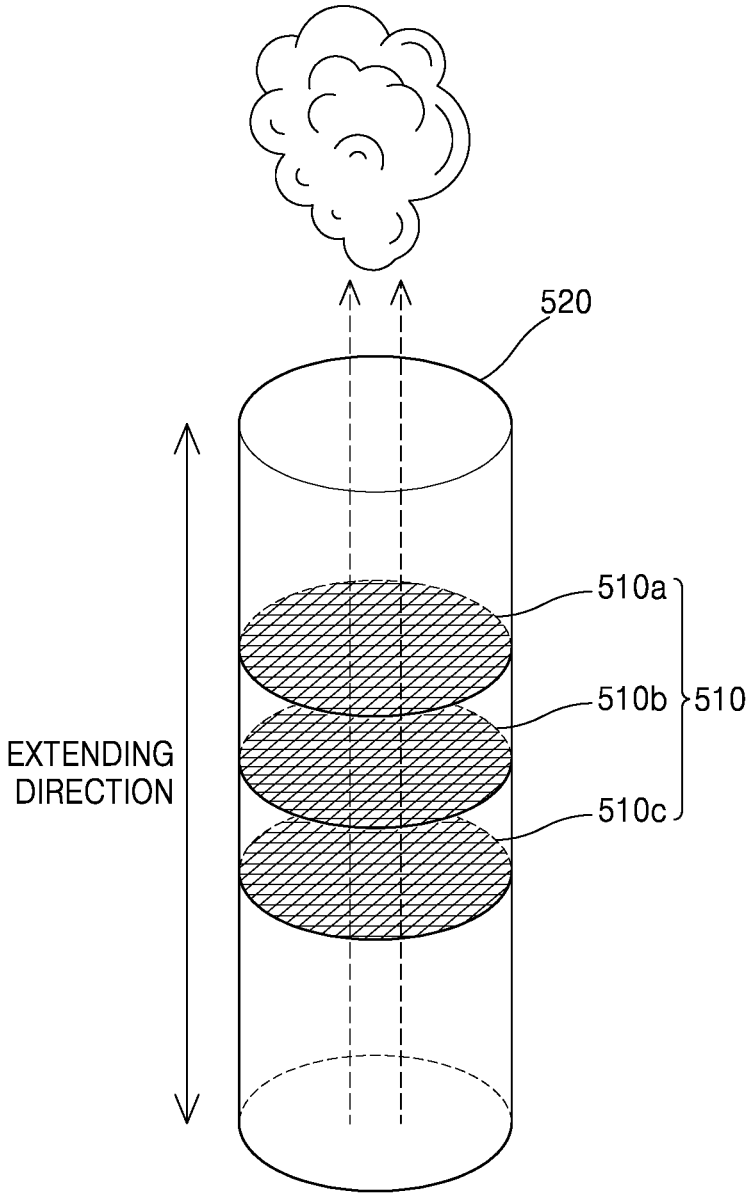
FIG. 10 is a diagram of an example of a heating wire having a multiple-layer structure.

FIG. 10 is a diagram of an example of a heating wire of a multiple-layer structure.

Referring to FIG. 10, multiple layers of the heating wire 510 may be arranged in a direction in which the air flow path 520 extends.

The heating wire 510 may be formed in a multiple-layer structure in which the layers are arranged in the direction in which the air flow path 520 extends. The direction in which the air flow path 520 extends may be a direction in which the aerosol passes through the air flow path 520. The layers in the heating wire 510 may be heated individually or together by a current flowing through the heating wire 510.

In an embodiment, the heating wire 510 having the multiple-layer structure may be formed of a single metal wire. A layer having a mesh shape may be formed as the single metal wire is bent and intersects with itself, and the same metal wire may be extended to form another layer in the same manner.

In other embodiments, each layer in the heating wire 510 may be formed of a separate single metal wire. As shown in FIG. 10, in the case of the heating wire 510 having a three-layer structure, a first heating wire 510*a* may be formed of a first metal wire, a second heating wire 510*b* may be formed of a second metal wire, and a third heating wire 510*c* may be formed of a third metal wire. Alternatively, the first heating wire 510*a* and the second heating wire 510*b* may be formed of the first metal wire, and the third heating wire 510*c* may be formed of the second metal wire.

In another embodiment, each layer of the heating wire 510 may be formed of a plurality of metal wires. Alternatively, some of the layers of the heating wire 510 may be formed of a plurality of metal wires, and other layers may be formed of a single metal wire.

Methods by which the heating wire 510 having the multiple-layer structure by the metal wires is not limited to the foregoing examples, and may be variously changed and embodied.

The cartridge may more efficiently heat the aerosol by applying the multiple-layer structure to the heating wire 510. The heating wire 510 may heat the aerosol passing through the air flow path 520 multiple times by using the layers, to thereby sufficiently heat the aerosol within a short time period during which the aerosol passes through the heating wire 510. The heating wire 510 may constantly maintain or gradually increase the temperature of the aerosol which passes through the air flow path 520, by heating the aerosol a plurality of times.

In the embodiment according to FIG. 10, the heating wire 510 is formed in a three-layer structure including the first heating wire 510*a*, the second heating wire 510*b*, and the third heating wire 510*c*. Although it is shown the layers are all arranged in parallel, angles between the layers may be variously set. In addition, intervals among the layers may be variously set.

Figure 11:
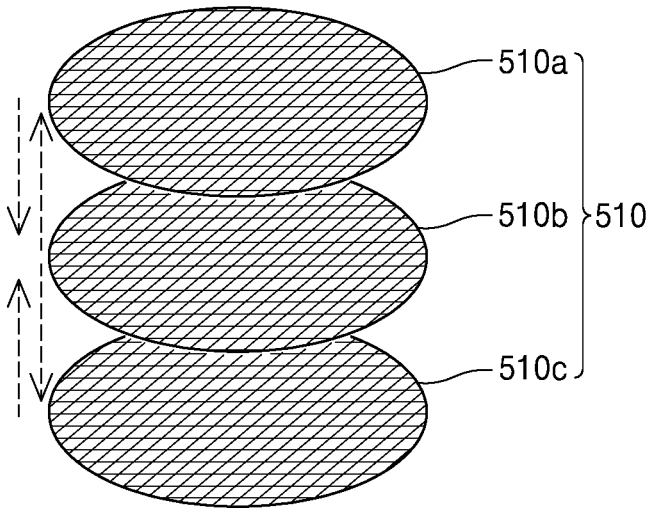
FIG. 11 is a diagram for describing an example of a method of heating a heating wire having a multiple-layer structure.

FIG. 11 is a diagram for describing an example of a method of heating the heating wire having the multiple-layer structure.

Referring to FIG. 11, the heating wire 510 having the multiple-layer structure may include the first heating wire 510*a*, the second heating wire 510*b*, and the third heating wire 510*c*.

As the current is applied to the heating wire 510, an electric field may be generated from the heating wire 510. The electric field generated in each layer of the heating wire 510 may be applied to other layers, and the other layers may be further heated due to the electric field.

As the electric field generated in one layer is applied to another layer, moles (or dipoles) in the other layer vibrate due to the influence of the electric field, and frictional heat may be generated from the vibration. To increase heating due to the electric field (or the frictional heat), the current applied to the heating wire 510 may be set to have higher frequency. Heating by the electric field may correspond to, for example, dielectric heating.

For example, a current may only be applied to some layers of the heating wire 510, and other layers may be heated by the electric field generated from the layers. Alternatively, as a current is applied to all of layers of the heating wire 510 and the electric fields generated from the layers have influence on one another, the heating wire 510 may be further heated. In this case, a magnitude of the current for each of the layers to heat the heating wire 510 to the target temperature may be smaller than a magnitude of the current to heat the heating wire 510 to the target temperature without the influence of the electric field.

In an embodiment according to FIG. 11, as an electric field generated in the second heating wire 510*b* is applied to the first heating wire 510*a* and the third heating wire 510*c*, the first heating wire 510*a* and the third heating wire 510*c* may be further heated. In addition, as the electric field generated in the first heating wire 510*a* and the third heating wire 510*c* is applied to the second heating wire 510*b*, the second heating wire 510*b* may be further heated. Furthermore, as an electric field generated in the first heating wire 510*a* is applied to the third heating wire 510*c*, the third heating wire 510*c* may be further heated, and as an electric field generated in the third heating wire 510*c* is applied to the first heating wire 510*a*, the first heating wire 510*a* may be further heated.

In the embodiment according to FIG. 11, even when the current is applied only to the second heating wire 510*b*, the first heating wire 510*a* and the third heating wire 510*c* may be heated due to influence of the electric field. In the case where the current is applied only to the second heating wire 510, the first heating wire 510*a* and the third heating wire 510*c* may also heat the aerosol. Alternatively, a small amount of current may be applied to all of the first heating wire 510*a* through the third heating wire 510*c*, in which case the heating wires are further heated due to influence of the electric fields, and therefore, the heating wire 510 may heat the aerosol sufficiently.

As described above, the heating wire 510 is not only heated directly due to the current applied to the heating wire 510 having the multiple-layer structure, but also heated indirectly due to the electric field, and thus, power consumed for heating the aerosol may be reduced.

Figure 12:
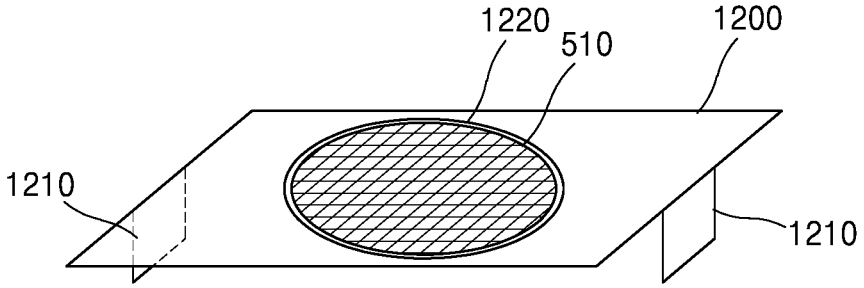
FIG. 12 is a diagram of an example of a circuit board.

FIG. 12 is a diagram of an example of a circuit board.

Referring to FIG. 12, the circuit board 1200 may include a contact device 1210 and a hole 1220. The heating wire 510 may be arranged in the hole 1220 of the circuit board 1200.

The cartridge may include the circuit board 1200. The circuit board 1200 may include an electric circuit that is configured by fixing electric components such as a resistor on a surface of the board and connecting the electric components with wires. For example, the circuit board 1200 may include a printed circuit board (PCB) or a flexible printed circuit board (FPBS), but types of the circuit board 1200 are not limited thereto.

The circuit board 1200 may include the contact device 1210 that is electrically connected to the aerosol-generating apparatus. The contact device 1210 is electrically connected to the aerosol-generating apparatus by contacting the aerosol-generating apparatus, and may receive a current from the aerosol-generating apparatus. The contact device 1210 may include, for example, a conductor material.

The contact device 1210 contacts the aerosol-generating apparatus when the cartridge is combined with the aerosol-generating apparatus. To this end, the contact device 1210 may be exposed to the outside of the cartridge in a state of being connected to the circuit board 1200. For example, the contact device 1210 may protrude downwards at two ends of the circuit board 1200 and may be attached to an outer wall surface of the cartridge. However, an arrangement of the contact device 1210 is not limited thereto, and may be variously arranged to contact the aerosol-generating apparatus.

The circuit board 1200 provides, to the heating wire 510, the current that is received through the contact device 1210. The circuit board 1200 may provide the current to the heating wire 510 through wires on the circuit board 1200. The wires on the circuit board 1200 may be arranged such that the current applied through a contact device 1210 is delivered to the entire heating wire 510.

The circuit board 1200 may include the hole 1220 having an area corresponding to the area of the heating wire 510. The hole 1220 may be designed such that the heating wire 510 is arranged in the hole 1220 and the aerosol may pass therethrough. The area of the hole 1220 may be equal to or greater than a cross-sectional area of the heating wire 510 such that the heating wire may be arranged therein.

The circuit board 1200 may be arranged in parallel to the heating wire 510. Also, the plane of the heating wire 510 may be arranged to be orthogonal to the direction in which the air flow path extends. However, the arrangement of the circuit board 1200 is not limited thereto, and the circuit board 1200 may be arranged at a different angle with respect to the heating wire 510.

Figure 13:
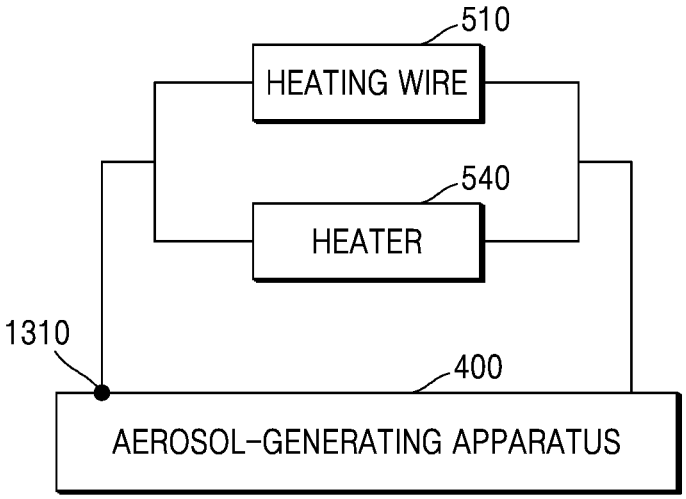
FIG. 13 is a block diagram of an example of a heater and a heating wire that are connected in parallel.

FIG. 13 is a block diagram of an example of the heater and the heating wire that are connected in parallel.

Referring to FIG. 13, the heater 540 and the heating wire 510 may be connected in parallel, and may be connected to the aerosol-generating apparatus 400.

The heater 540 and the heating wire 510, which are connected in parallel, may receive a current applied from the aerosol-generating apparatus 400 through an electrode 1310. A same voltage is applied to the heating wire 510 and the heater 540 and different currents which are reverse proportional to the resistances of the heating wire 510 and the heater 540 may be applied to the heating wire 510 and the heater 540. This may be explained according to the current division rule.

As the heating wire 510 and the heater 540 need to be heated to different temperatures, currents to be applied to the heating wire 510 and the heater 540 may also have different magnitudes. Therefore, the heating wire 510 and the heater 540 may have different resistances such that different currents are applied to the heating wire 510 and the heater 540 based on the resistances. For example, a heating temperature of the heater 540 may be higher than a heating temperature of the heating wire 510. In this case, the heater 540 may be designed to have a resistance lower than that of the heating wire 510 such that a current applied to the heater 540 is greater than a current applied to the heating wire 510.

As the heating wire 510 and the heater 540 are connected in parallel and have different resistances, the aerosol-generating apparatus 400 may control the heating wire 510 and the heater 540 to have different temperatures by applying the current through one electrode 1310, without separately applying the current.

At least one of the heater 540 and the heating wire 510 may have a variable resistance. By varying the resistance of the heater 540 or the heating wire 510, a magnitude of the current applied to each may be adjusted. The resistance of the heater 540 or the heating wire 510 may be adjusted based on the temperature of the heater 540 or the heating wire 510. For example, the variable resistance of the heating wire 510 may be adjusted to control the temperature of the heating wire 510 based on the temperature of the heater 540.

Figure 14:
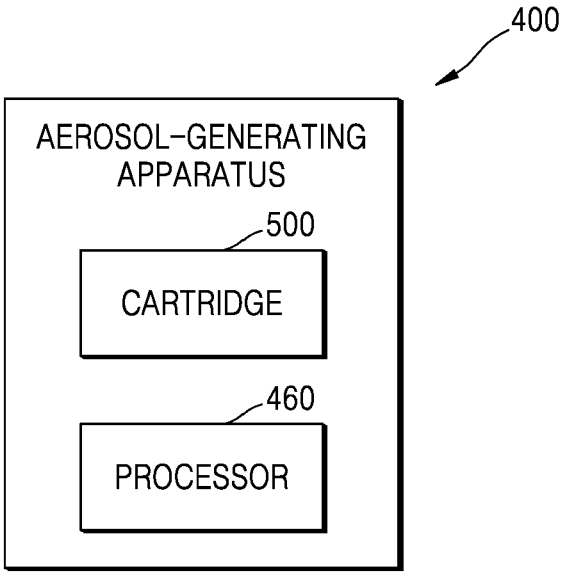
FIG. 14 is a block diagram of another example of a configuration of an aerosol-generating apparatus.

FIG. 14 is a block diagram of another example of a configuration of the aerosol-generating apparatus.

Referring to FIG. 14, the aerosol-generating apparatus 400 may include the cartridge 500 and the processor 460. The cartridge 500 and the processor 460 shown in FIG. 14 may correspond to the cartridge 500 shown in FIG. 5 and the processor 460 shown in FIG. 4.

FIG. 14 illustrates components of the aerosol-generating apparatus 400, which are related to the present embodiment. Therefore, it will be understood by one of ordinary skill in the art related to the present embodiment that other general-purpose components may be further included in the aerosol-generating apparatus 400, in addition to the components illustrated in FIG. 14.

The processor 460 may be electrically connected to the cartridge 500 and may electrically control each component of the cartridge 500. The processor 460 may apply a current to the heater and the heating wire such that the heater and the heating wire are heated.

The processor 460 may measure a temperature of the heater. In addition, the processor 460 may measure the temperature of the aerosol that is discharged to the outside of the cartridge 500. For example, the processor 460 may measure the temperature of the aerosol in the discharge hole.

The aerosol-generating apparatus 400 may include a temperature detecting sensor configured to detect the temperature of the heater or the aerosol, and the processor 460 may measure the temperature of the heater or the aerosol based on a signal received from the temperature detecting sensor. The temperature detecting sensor may be included in the cartridge, or may be included in the main body of the aerosol-generating apparatus.

The processor 460 may control, based on the temperature of the heater, the temperature of the heating wire such that the temperature of the aerosol that is discharged to the outside of the cartridge 500 reaches the target temperature. The target temperature of the aerosol that is discharged to the outside of the cartridge 500 may include, for example, the target temperature of the aerosol in the discharge hole. The processor 460 may control the temperature of the heating wire and the temperature of the heater to be in a negative correlation.

The processor 460 may control the temperature of the heating wire such that the temperature of the aerosol in the discharge hole is 45° C. or higher.

The processor 460 may control the temperature of the heating wire such that the temperature of the aerosol in the discharge hole is at least 15° C. higher than when the aerosol is not heated.

The processor 460 may control the heating wire to be heated to 60° C. or higher and 80° C. or lower.

One embodiment may also be implemented in the form of a recording medium including instructions executable by a computer, such as a program module executable by the computer. A computer-readable medium may be any available medium that can be accessed by a computer and includes a volatile medium, a nonvolatile medium, a removable medium, and a non-removable medium. In addition, the computer-readable medium may include both a computer storage medium and a communication medium. The computer storage medium includes all of a volatile medium, a nonvolatile medium, a removable medium, and a non-removable medium implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. A cartridge used for an aerosol-generating apparatus, the cartridge comprising:

a liquid storage configured to store an aerosol-generating material;

a heater configured to generate an aerosol by heating the aerosol-generating material;

an air flow path through which the aerosol passes to be discharged to the outside of the cartridge;

a mouthpiece connected to the air flow path and configured to be inserted into an oral cavity of a user, the mouthpiece comprising a discharge hole configured to discharge the aerosol to the outside of the cartridge; and a heating wire having a mesh shape, configured to generate heat, and arranged in the air flow path, wherein the heating wire is configured such that the aerosol, which is generated by the heater and then cooled while passing through the air flow path, is heated in contact with the heating wire while moving to the mouthpiece.

2. The cartridge of claim 1, wherein the mesh shape comprises a plurality of pores through which the aerosol passes.

3. The cartridge of claim 2, wherein a shape of each of the plurality of pores is a rectangle in which a length of a short side is 0.5 μm or greater and 1.0 μm or less, or a square in which a length of a side is 0.5 μm or greater and 1.0 μm or less.

4. The cartridge of claim 1, wherein the heating wire is configured to block a portion of the aerosol-generating material entering the air flow path in an unvaporized state from being discharged to the outside of the cartridge.

5. The cartridge of claim 4, wherein the heating wire is configured to generate the aerosol by heating the portion of the aerosol-generating material.

6. The cartridge of claim 1, wherein the heating wire has a multiple-layer structure in which layers are arranged in a direction in which the air flow path extends.

7. The cartridge of claim 6, wherein one layer in the multiple-layer structure is configured to be heated by an electric field generated by another layer in the multiple-layer structure.

8. The cartridge of claim 1, wherein a temperature of the heating wire is controlled such that a temperature of the aerosol in the discharge hole reaches a target temperature, based on a temperature of the heater.

9. The cartridge of claim 1, wherein the temperature of the heating wire and the temperature of the heater are controlled to have a negative correlation.

10. The cartridge of claim 1, wherein the heating wire heats the aerosol such that a temperature of the aerosol in the discharge hole is 45° C. or higher.

11. The cartridge of claim 1, wherein the heating wire heats the aerosol such that a temperature of the aerosol in the discharge hole is at least 15° C. higher than when the aerosol is not heated.

12. The cartridge of claim 1, wherein the heating wire is heated to 60° C. or higher and 80° C. or lower.

13. The cartridge of claim 1, further comprising a contact device configured to provide an electric connection with the aerosol-generating apparatus such that a current is delivered from the aerosol-generating apparatus to the heating wire through the contact device.

14. An aerosol-generating apparatus comprising:

the cartridge of claim 1; and a processor configured to apply a current to the heater and the heating wire such that the heater and the heating wire are heated.

* * * * *